US005440379A

United States Patent [19]

Hayamizu

[11] Patent Number: 5,440,379

[45] Date of Patent: Aug. 8, 1995

[54] IMAGE TRANSFER DEVICE WITH CLEANER FOR ELECTROPHOTOGRAPHIC COPYING

[75] Inventor: Tadashi Hayamizu, Fukuoka, Japan

[73] Assignee: Matsushita Electric Industrial Co., Ltd., Osaka, Japan

[21] Appl. No.: 131,582

[22] Filed: Oct. 5, 1993

[30] Foreign Application Priority Data

Oct. 6, 1992 [JP] Japan ..... 4-267073

[51] Int. Cl.[6] ..... G03G 15/14

[52] U.S. Cl. ..... 355/271; 15/256.51

[58] Field of Search ..... 355/271, 273, 274, 276; 15/256.5, 256.51

[56] References Cited

U.S. PATENT DOCUMENTS

| | | | |
|---|---|---|---|
| 3,847,478 | 11/1974 | Young | 355/274 |
| 4,413,898 | 11/1983 | Anne | 355/274 X |
| 4,862,224 | 8/1989 | Ku | 355/271 X |
| 4,875,069 | 10/1989 | Takada et al. | 355/271 |
| 4,931,839 | 6/1990 | Tompkins et al. | 355/271 X |
| 5,027,159 | 6/1991 | Oda et al. | 355/271 |
| 5,051,783 | 9/1991 | Sato | 355/271 |

FOREIGN PATENT DOCUMENTS

| | | | |
|---|---|---|---|
| 0420557 | 4/1991 | European Pat. Off. . | |
| 58-105268 | 6/1983 | Japan . | |
| 59-087481 | 5/1984 | Japan . | |
| 2-163777 | 6/1990 | Japan . | |
| 2-239271 | 9/1990 | Japan | 355/271 |
| 4-081785 | 3/1992 | Japan . | |
| 4-182684 | 6/1992 | Japan | 355/273 |
| 4-191776 | 7/1992 | Japan . | |
| 4-194886 | 7/1992 | Japan . | |
| 4-263279 | 9/1992 | Japan . | |
| 5-53456 | 3/1993 | Japan | 355/271 |

OTHER PUBLICATIONS

European Search Report.

*Primary Examiner*—William J. Royer

*Attorney, Agent, or Firm*—Lowe, Price, LeBlanc & Becker

[57] ABSTRACT

An image-transferring system which may be employed in an electrophotographic type of copying machine. The image-transferring system includes an image transfer member on which a toner image is formed, a transfer roller arranged to hold a transfer paper along with the image transfer member to transfer the toner image formed on the image transfer member onto the transfer paper, a cleaner arranged to clean a surface of the transfer roller before the image-transferring operation, and a cleaner supporting member which is designed to support the cleaner for controlling a cleaning operation of the cleaner with given timing where the cleaner engages the transfer roller in response to engagement motion of the transfer roller with the image transfer member.

17 Claims, 7 Drawing Sheets

IMAGE TRANSFER DEVICE WITH CLEANER FOR ELECTROPHOTOGRAPHIC COPYING

BACKGROUND OF THE INVENTION

1. Technical Field of the Invention

The present invention relates generally an image-transferring system which may be employed in an electrophotographic type of copying machine. More specifically, the invention relates to an improvement on an image-transferring system with a cleaner for cleaning a surface of a transfer roller which serves to transfer a toner image formed on a photosensitive medium onto a transfer paper.

2. Background Art

A conventional color printer will be described hereinbelow with reference to FIGS. 6–8.

A stack of sheets of transfer paper 37 is stored on a paper stacking plate 102 arranged in a paper tray 10 1 so that the transfer paper 37 may be transported to a pick-up roller 103. A one-cycle clutch 104 is arranged to restrict rotational movement of the pickup roller 103. A register sensor 105 is mounted above the pick-up roller 103 to detect the transfer paper 37 fed from the paper tray 101. On the transfer paper 37, a toner image is transferred by an image-transferring device, as will be described later, and then fixed thereon by a fixing unit 108 which includes a heat roller 106 for heating the transfer paper 37 and a pressure roller 107 for urging the transfer paper 37 against the heat roller 106. A first ejected paper sensor 109 is arranged to detect the image-transferred paper passed through the fixing unit 108. A pair of ejecting paper rollers 110 and 111 directs the image-transferred paper toward an outlet port. A second ejected paper sensor 112 is installed downstream of the ejecting paper rollers 110 and 111 to detect the image-transferred paper in the outlet port. A pair of outlet rollers 113 and 114 feeds the image-transferred paper to an ejected paper tray 115. A selector flap 116 is provided to select an ejecting path for the image-transferred paper. A selector roller assembly including three rollers 117 transports the image-transferred paper along the ejecting path selected by the selector flap 116. An exposure unit 118 is disposed in an upper portion of the printer, and serves to radiate exposing light onto a belt-like photosensitive medium 1 to form a latent image thereon. A controller 119 and a high-voltage unit 120 are provided.

FIG. 7 shows the image-transferring device when not serving to image-transfer. The belt-like photosensitive medium 1 is made of a dielectric material, and is supported for rotation at a constant speed for establishing a developing operation. Around the belt-like photosensitive medium 1, an electrifier 2 for electrifying the belt-like photosensitive medium 1, the exposure unit 118 (not shown in FIG. 7) for exposing the belt-like photosensitive medium 1, four developing units 4 for developing three primary colors and black on the belt-like photosensitive medium 1 respectively, a cleaner 5 for removing unnecessary toners left on the belt-like photosensitive medium 1, and a discharging unit 6 for removing a charge from the belt-like photosensitive medium 1. The belt-like photosensitive medium 1 contacts with an intermediate transfer belt 7 at a location downstream of the developing units 4 in a rotational direction of the belt-like photosensitive medium 1.

The intermediate transfer belt 7 is made of a dielectric material, and is driven to rotate in synchronism with the belt-like photosensitive medium 1. At a location upstream of a contact area of the intermediate transfer belt 7 with the belt-like photosensitive medium 1 in a rotational direction of the intermediate transfer belt 7, a cleaner 8 is arranged to remove unnecessary toners left on the intermediate transfer belt 7. The cleaner 8 is attached to one end of a pivotable plate 9 which is pivotably supported by a shaft 10. On the other end of the pivotable plate 9, a cam 11 and a spring 12 which serves to urge the pivotable plate 9 against the cam 11 are secured.

At a location downstream of the contact area of the intermediate transfer belt 7 with the belt-like photosensitive medium 1 in the rotational direction of the intermediate transfer belt 7, a platen or transfer roller 21 is arranged which is pivotally mounted on an end of a pivotable plate 23 functioning as a cam follower, and is driven to rotate in synchronism with the rotational movement of the intermediate transfer belt 7. The pivotable plate 23 is pivotally supported by a shaft 24. A spring 26 is installed on the other end of the pivotable plate 23 opposite the end on which the transfer roller 21 is arranged. The spring 26 serves to urge the pivotable plate 23 against a surface of the cam 25. The cam 25 is secured on a shaft 27 and includes a projecting portion **25*a* for separating the transfer roller 21 from the intermediate transfer belt 7 and a recessed, or fiat portion 25*b* for bringing the transfer roller 21 into engagement with the intermediate transfer belt 7. Attached to an end of the shaft 27 is a half cycle clutch 28**.

The half cycle clutch 28 includes a pair of engaging portions **28*a* at locations substantially corresponding to the projecting portion 25*a* and the fiat portion 25*b* of the cam 25, respectively. One of the engaging portions 28*a* engages an actuator 29*a* to restrict rotational movement of the half cycle clutch 28. The actuator 29*a* is drawn to a solenoid 29 upon energization of the solenoid thereof so that it is shifted away from from the engaging portion 28. Alternatively, when the solenoid is deenergized, it will cause a spring 29*b* to bias the actuator 29*a* into engagement with the engaging portion 28 of the half cycle clutch 28**.

A cleaning blade 31 is bonded to a cleaning frame 30. The cleaning blade 31 is operable to remove unnecessary toners and/or paper powders from a surface of the transfer roller 21. The cleaning frame 30 is installed on the pivotable plate 23 at a location where the cleaning blade 31 contacts the transfer roller 21. The transfer roller 21 and the cleaning blade 31 are urged into constant engagement with each other by their own elasticity.

Adjacent the intermediate transfer belt 7 and the transfer roller 21, a pair of feeding rollers 32 and 33 for feeding the transfer paper 37 to the image-transferring station and paper guide plates 34, 35, and 36 are arranged.

In operation, when an image-transferring command is issued to the printer, the controller 119 is initiated to prepare image-transferring data and transports the transfer paper 37 to the image-transferring station in the following manner. The one cycle clutch 104, as shown in FIG. 6, is initially actuated to cause the pick up roller 103 to rotate by one cycle so that one sheet of transfer paper 37 stacked on the paper stacking plate 102 is fed out of the paper tray 101. When the register sensor 105 detects the presence of the transfer paper 37 traveling along a feed path, it will cause the transport of the transfer paper 37 to be stopped so that the transfer paper 37 waits temporarily while being held by the feeding rollers 32 and 33 for synchronism with image-transferring timing.

A full color image of the image-transferring data is developed on the belt-like photosensitive medium 1 in the following manner. The belt-like photosensitive medium 1 which has already been cleaned by the cleaner 5 and discharged by the discharging unit 6, is electrified by the electrifier 2 again and then exposed to the exposure light 3 from the exposure unit 118 corresponding to one color of a transferring image to form a latent image thereon. When the belt-like photosensitive medium 1 passes through the developing unit 4, a toner corresponding to one color of the transferring image is deposited on the latent image formed on the medium 1 according to an image shade to form a one-color image. The toner is then transferred onto the intermediate transfer belt 7. The belt-like photosensitive medium 1 then proceeds to a subsequent developing process of developing another color. With repetition of the above process, the belt-like photosensitive medium transfers the toners of full color onto the intermediate transfer belt 7 in overlapping relation according to the shade of the transferring image.

During a time period from the beginning of the synthesis operation of the toners of four colors on the intermediate transfer belt 7 to the end of image-transferring operation onto the transfer paper, the cleaner 8 is maintained separate from the intermediate transfer belt 7 by the pivotable plate 9 urged by the cam 11 in a counterclockwise direction, as viewed in the drawings. The transfer roller 21 is also maintained separate from the intermediate transfer belt 7 by the pivotable plate 23 urged by the cam 25 downward until the synthesis operation on the intermediate transfer belt 7 is completed.

The image-transferring operation onto the transfer paper 37 will be described with reference to FIG. 8.

When the transfer paper 37 is transported by the feeding rollers 32 and 33 to the given location in the image-transferring station, the solenoid 29 is turned on and off one time, thereby causing the engaging portion 28*a* of the half cycle clutch 28 to be released for allowing rotation thereof. Upon rotation by half, the other engaging portion 28*a* engages the actuator 29*a* so that the movement of the half cycle clutch 28 is restricted. During the half revolution of the half cycle clutch 28, the cam 25 arranged coaxially with the clutch 28 also rotates by half, causing the pivotable plate 23 which is urged against the fiat portion 25*b* of the cam 25 by the spring 26 to rotate about the shaft 24 so that the transfer roller 21 engages the intermediate transfer belt 7. Immediately after this engagement, the transfer paper 37 is fed to the image-transferring station and then is held between the intermediate transfer belt 7 and the transfer roller 21 so that the full color toner image provided on the intermediate transfer belt 7 is transferred onto the transfer paper 37.

Subsequently, when the image-transferred paper 37 has passed through the image-transferring station, the solenoid is turned on and off again. The half cycle clutch 28 then repeats the above mentioned operation. The transfer roller 21 is shifted away from the intermediate transfer belt 7 and waits a subsequent image-transferring operation in the position, as shown in FIG. 7.

While the image-transferred paper 37 travels on the paper guide plate 36, the full color toner image is fixed by the fixing unit 108, as shown in Fig, 6. Upon the passage of the image-transferred paper 37 through the fixing unit 108 being detected by the first ejected paper sensor 109, determination is made which surface of the printed paper 37 should be placed upward on the ejected paper tray 115 and the selector flap then selects the ejecting path so that the image-transferred paper 37 is ejected by the ejected paper rollers 110 and 111 and the outlet rollers 113 and 114 onto the ejected paper tray 115 with the selected surface being placed upward. When the second ejected paper sensor 112 detects the presence of the image-transferred paper 37, all image-transferring operations terminate.

With the above arrangements, for a period of time between the transport of the transfer paper to the image-transferring station and the ejection thereof to the ejected paper tray 115, the image-transferring and the transfer paper transport mechanisms remain operating. The transfer roller 21 thus remains rotating together with the cleaning blade 31 which is urged into constant engagement with the transfer roller 21. Usually, the transfer roller 21 and the cleaning blade 31 are made of an elastic material such as urethane or silicone rubber. Therefore, the transfer roller 21 and the cleaning blade 31 tend to wear prematurely, resulting the lifespan of the system being shortened.

SUMMARY OF THE INVENTION

It is therefore a principal object of the present invention to avoid the disadvantages of the prior art.

It is another object of the present invention to provide an improvement on an image-transferring device wherein operational timing of engagement and disengagement of a cleaner with and from a transfer roller is optimized to prolong the lifetime of the cleaner for providing clean and high-quality images.

According to one aspect of the present invention, there is provided an image-transferring apparatus which comprises an image transfer member on which a toner image is formed, a transfer cylindrical member arranged to hold a transfer paper along with the image transfer member to transfer the toner image formed on the image transfer member onto the transfer paper, and a contact cleaner arranged to engage a surface of the transfer cylindrical member for cleaning the surface of the transfer cylindrical member, and a cleaner supporting member adapted to support the contact cleaner to selectively establish engagement and disengagement of the contact cleaner with and from the transfer cylindrical member.

According to another aspect of the present invention, there is provided an image-transferring apparatus which comprises an image transfer member on which a toner image is formed, a transfer cylindrical member arranged to hold a transfer paper along with the image transfer member to transfer the toner image formed on the image transfer member onto the transfer paper, a contact cleaner arranged to engage a surface of said transfer cylindrical member for cleaning the surface of the transfer cylindrical member, and a cleaner supporting member arranged to support the contact cleaner to selectively establish engagement and disengagement of the contact cleaner with and from the transfer cylindrical member, the cleaner supporting member being so constructed as to perform an engagement/disengagement operation of the contact cleaner together with an engagement/disengagement operation of the transfer cylindrical member with respect to the image transfer member.

According to a further aspect of the present invention, there is provided an image-transferring apparatus which comprises an image transfer member on which a toner image is formed, a transfer cylindrical member arranged to hold a transfer paper along with the image transfer member to transfer the toner image formed on the image transfer member onto the transfer paper, a cam-like projecting member provided on a transfer cylindrical member supporting member which pivotally supports the transfer cylindrical member, a contact cleaner operable to clean a surface of the transfer cylindrical member, a cleaner supporting member arranged to support the contact cleaner to selectively establish engagement and disengagement of the contact cleaner with and from the transfer cylindrical member together with engagement and disengagement of the transfer cylindrical member with and from the image transfer member, and an urging means, associated with the cleaner supporting member, for urging the contact cleaner against the transfer cylindrical member, wherein the cam-like projecting member is arranged to establish first and second positions according to position of the transfer cylindrical member supporting member, the first position being to establish engagement with the cleaner supporting member, the second position being to establish disengagement from the cleaner supporting member, when the transfer cylindrical member supporting member is moved to establish engagement of the transfer cylindrical member with the image transfer member, the cam-like projecting member assumes the first position where the cleaner supporting member brings the contact cleaner into engagement with the transfer cylindrical member, when the transfer cylindrical member supporting member is moved to establish disengagement of the transfer cylindrical member from the image transfer member, the cam-like projecting member assumes the second position where the cleaner supporting member brings the contact cleaner out of the engagement with the transfer cylindrical member.

In the preferred mode, the cam-like projecting member allows the urging means to urge the contact cleaner into engagement with the transfer cylindrical member at the first position, and restricts the urging means from urging the contact cleaner against the transfer cylindrical member, thereby causing the contact cleaner to be disengaged from the transfer cylindrical member at the second position.

According to a still further aspect of the present invention, there is provided a printing apparatus including an image transfer device of the type, as described above.

According to a yet further aspect of the invention, there is provided an image-transferring apparatus which comprises an image transfer member on which a toner image is formed, a transfer paper engaging member arranged to have a transfer paper engage the image transfer member to transfer the toner image formed on the image transfer member onto the transfer paper, a cleaner operable to clean a surface of the transfer paper engaging member, a supporting member arranged to support the transfer paper engaging member over a range from first to second support positions, the first support position being to establish disengagement of the transfer paper engaging member from the image transfer member, the second support position being to establish engagement of the transfer paper engaging member with the image transfer member, and a cam member adapted to be responsive to movement of the supporting member to selectively establish engagement and disengagement of the the transfer paper engaging member with and from the cleaner, the cam member bringing the transfer paper engaging member into disengagement from the cleaner when the supporting member assumes the first support position, the cam member bringing the transfer paper engaging member into engagement with the cleaner when the supporting member is shifted from the first supporting position to the second supporting position.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings:

FIG. 4(*b*) is a time chart which shows the operational timing between a transfer roller and a cleaning blade.

DESCRIPTION OF THE PREFERRED EMBODIMENT

Figure 1:
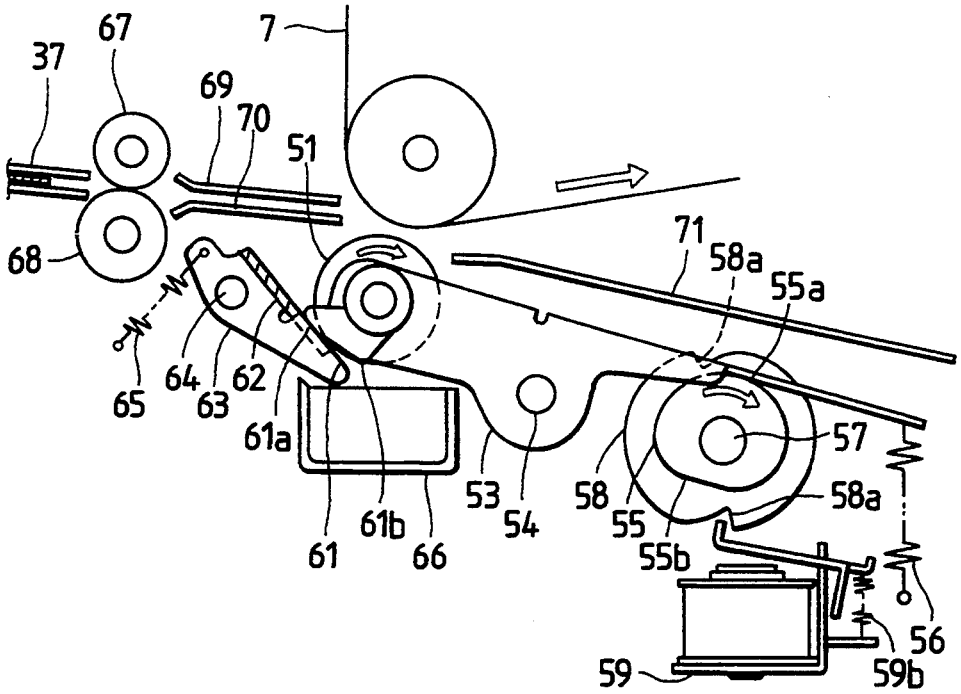
FIG. 1 is a side view which shows an image-transferring device according to the present invention.
Figure 2:
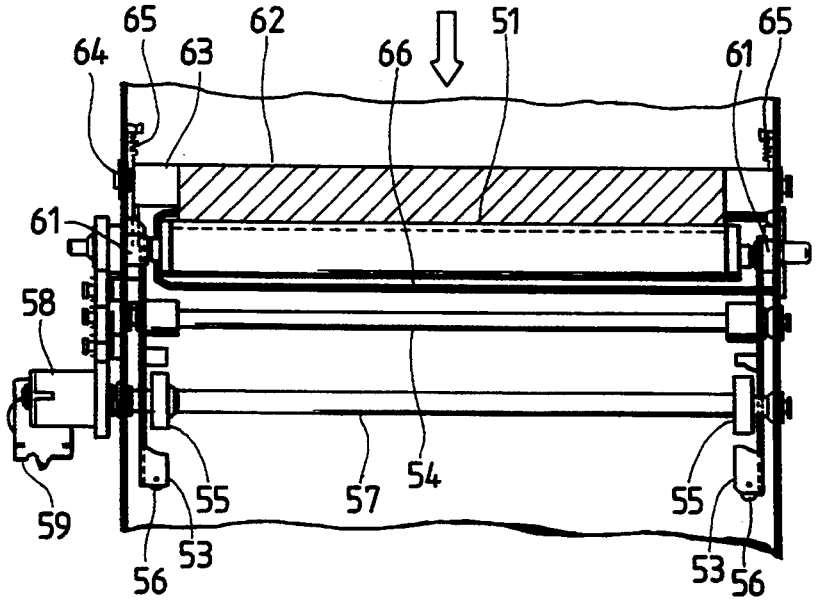
FIG. 2 is a plan view which shows an image-transferring device of the invention when not serving to image-transfer.
Figure 3:
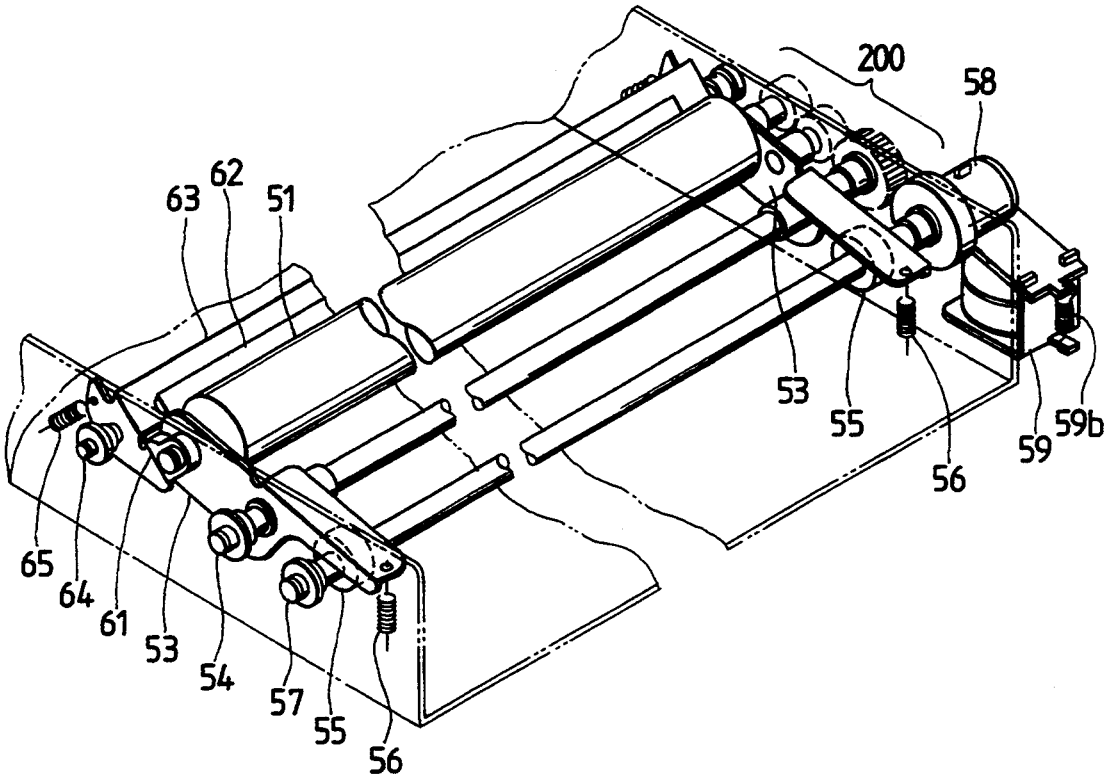
FIG. 3 is a partially perspective view which shows essential part of an image-transferring device of the invention.
Figure 6:
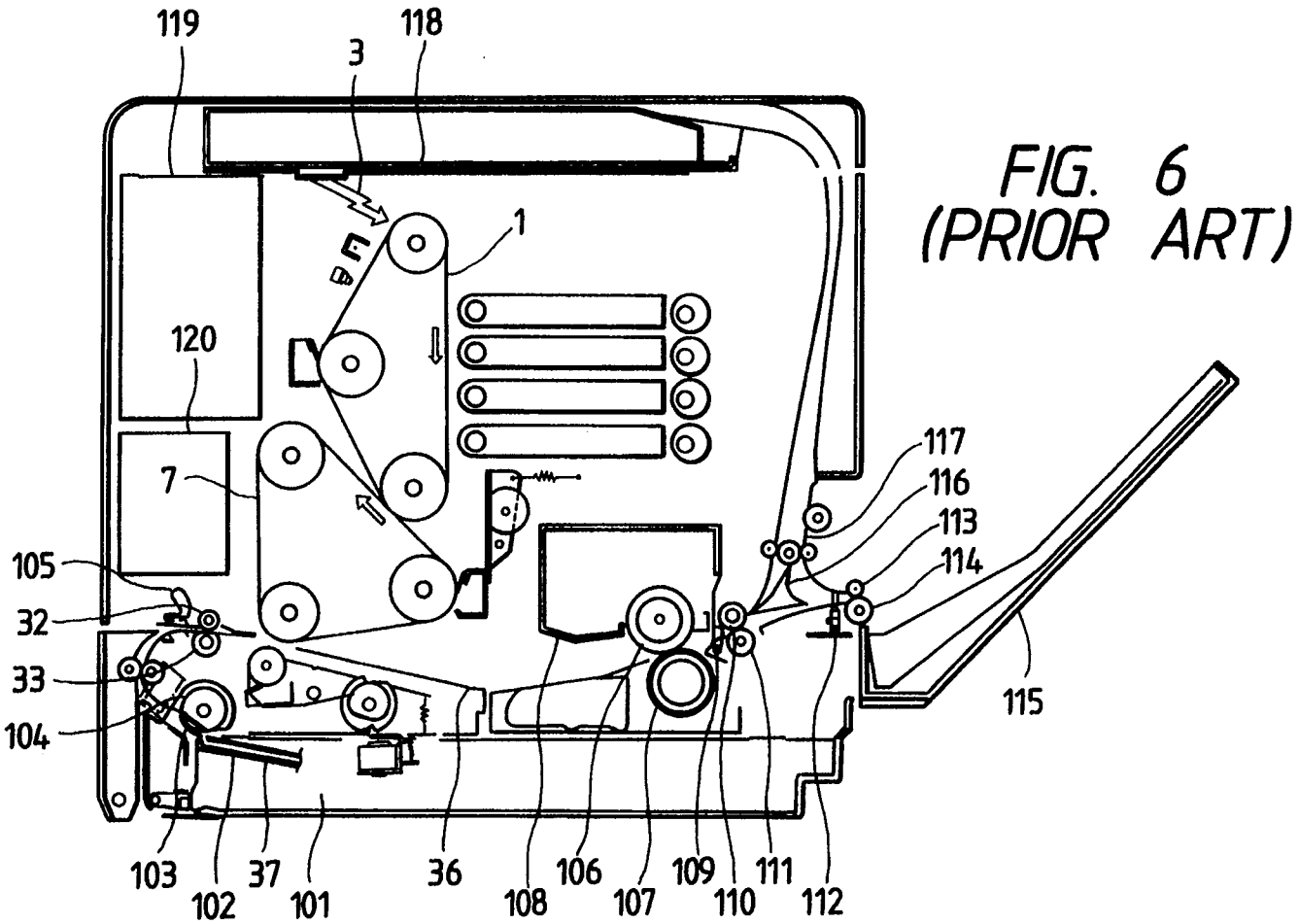
FIG. 6 (PRIOR ART)
FIG. 6 is a sectional view which shows a prior art color printer using a conventional image-transferring device.
Figure 7:
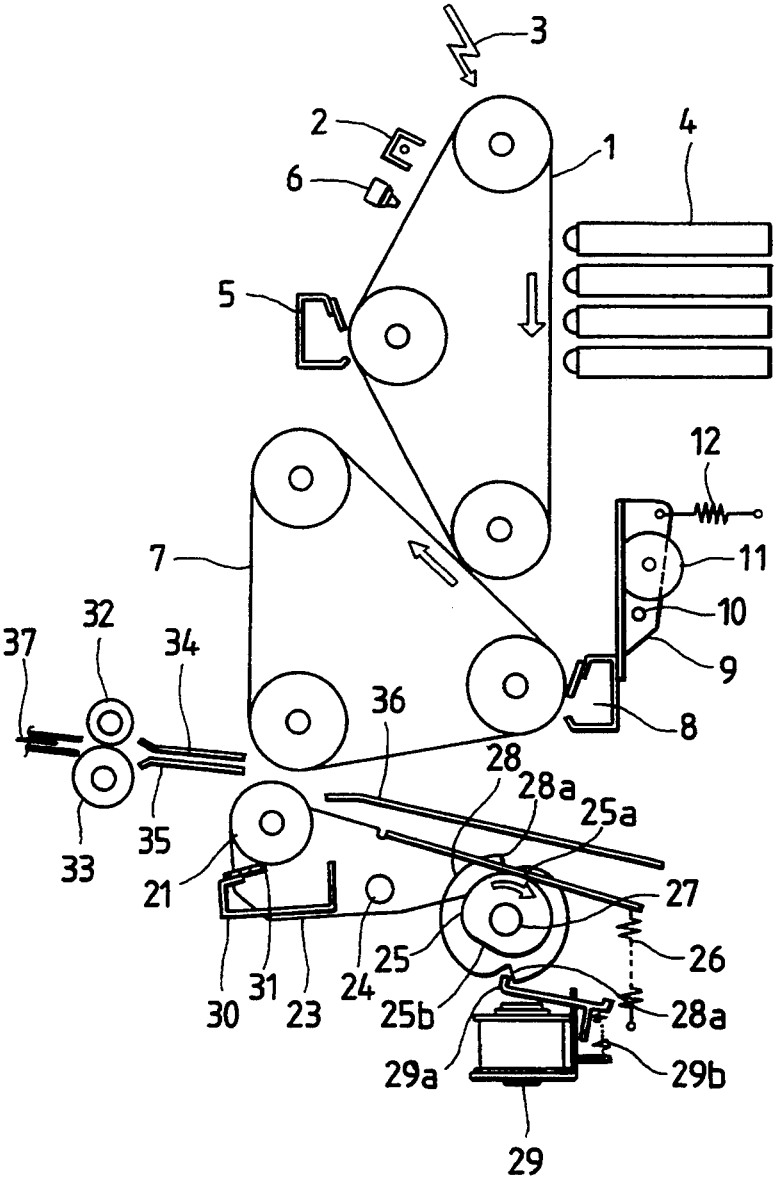
FIG. 7 (PRIOR ART)
FIG. 7 is a side view which shows a conventional image-transferring device when not serving to image-transfer.
Figure 8:
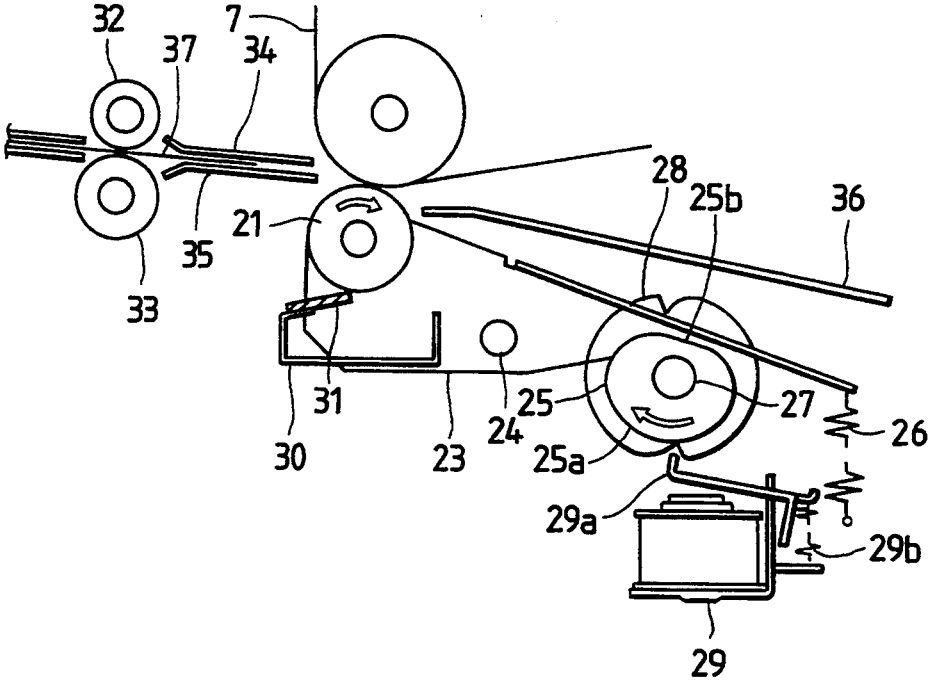
FIG. 8 (PRIOR ART)
FIG. 8 is a side view which shows a conventional image-transferring device when serving to image-transfer.

Referring now to the drawings, particularly to FIGS. 1, 2 and 3, there is shown an image-transferring device according to the present invention which may be incorporated in a color printer of the type, as discussed in the introductory part of the present application, whose arrangements form part of the present invention. In the following discussion, the same numbers refer to the same parts as shown in FIGS. 6, 7, and 8, and explanation thereof in detail will be omitted here for the sake of brevity, The image transferring device includes a rotatable transfer roller 51 which is made of a cylindrical member and is arranged at a location downstream of a contact area of an intermediate transfer belt 7 with a belt-like photosensitive medium 1 in a rotational direction of the intermediate transfer belt 7. The transfer roller 51 is pivotally mounted on an end of a pivotable plate 53 functioning as a cam follower, as will be appreciated later, A cleaner cam 61 is supported by a bearing of the transfer roller 51 at the end of the pivotable plate 53, The pivotable plate 53 is pivotally supported by a shaft 54, A spring 56 is hung on the other end of the pivotable plate 53 opposite the end on which the transfer roller 51 is arranged. The spring 56 serves to urge the pivotable plate 53 against a surface of a cam 55. The cam 55 is secured on a shaft 57 and includes a projecting portion 55*a* for separating the transfer roller 51 from the intermediate transfer belt 7 and a recessed, or fiat portion 55*b* for bringing the transfer roller 51 into engagement with the intermediate transfer belt 7. Attached to an end of the shaft 57 is a half cycle clutch 58.

The half cycle clutch 58 includes a pair of engaging portions 58*a* at locations substantially corresponding to the projecting portion 55*a* and the fiat portion 55*b* of the cam 55, respectively. One of the engaging portions 58*a* engages an actuator 59*a* to restrict rotational movement of the half cycle clutch 58. When a solenoid 59 is deenergized, it will cause a spring 59*b* to bias the actuator 59*a* into engagement with the engaging portion 58*a* of the half cycle clutch 58 so that torque of a motor (not shown) transmitted to the half cycle clutch 58 through a gear train 200, as shown in FIG. 3, is not transmitted to the shaft 57. Alternatively, when the solenoid 59 is energized, the actuator 59*a* is drawn to the solenoid 59 so that it is separated from the engaging portion 58*a*. This establishes the torque transmission between the motor and the shah 57 through the half cycle clutch 58 until the actuator 59*a* engages the other of the engaging portion 58*a* again.

A cleaning blade 62 is bonded to a cleaning frame 63. The cleaning blade 62 is operable to remove unnecessary toners and/or paper powders from a surface of the transfer roller 51. A spring 65 is attached to an end of the cleaning frame 63 to urge the cleaning frame 63 against the cleaner cam 61. The transfer roller 51 and the cleaning blade 62 are made of an elastic material such as urethane or silicone rubber. Beneath the transfer roller 51 and the cleaning blade 62, a waste toner tray 66 is provided.

Adjacent an image-transferring station where the intermediate transfer belt 7 and the transfer roller 51 are provided, a pair of paper feeding rollers 67 and 68 for feeding a transfer paper 37 to the image-transferring station and paper guide plates 69, 70, and 71 are arranged.

In operation, the intermediate transfer belt 7 which has been cleaned by the cleaner 8, as shown in FIG. 7, is responsive to a printing command signal to rotate in synchronism with rotational movement of the belt-like photosensitive medium 1 so that four colors are sequentially developed on the belt-like photosensitive medium 1 and at the same time, toners of four colors are sequentially synthesized on the intermediate transfer belt 7.

Before a toner image is transferred onto the transfer paper 37 following the synthesis of the toners of four colors on the intermediate transfer belt 7, the transfer roller 51 remains separate from the intermediate transfer belt 7 by the activity of the pivotable plate 53 urged by the cam 55 in a counterclockwise direction, as viewed in the drawings, while a first projecting portion 61*a* of the cleaner cam 61 is urged by the activity of the pivotable plate 53 into engagement with the cleaning frame 63 against the spring force of the spring 65 so that the cleaning blade 62 is shifted away from the transfer roller 51. In other words, the cleaner cam 61 is responsive to the movement of the pivotable plate 53 to restrict the cleaning frame 63 (i.e., the spring 65) from urging the cleaning blade 62 against the transfer roller 51, thereby causing the cleaning blade 62 to be disengaged from the transfer roller 51.

Subsequently, when the transfer paper 37 is transported by the paper feeding rollers 67 and 68 to a given location in the image-transferring station, the solenoid 59 is turned on and off one time, thereby causing the engaging portion 58*a* of the half cycle clutch 58 to Be released so that the half cycle clutch 58 begins to rotate. Upon rotation by half, the other engaging portion 58*a* engages the actuator 59*a* so that the movement of the half cycle clutch 58 is restricted. During the half rotation of the half cycle clutch 58, the cam 55 arranged coaxially with the half cycle clutch 58 also rotates by half, causing the pivotable plate 53 to engage the fiat surface 55*b* of the cam 55 with rotation about the shaft 54 so that the transfer roller 51 is brought into engagement with the intermediate transfer belt 7.

Figure 4A:
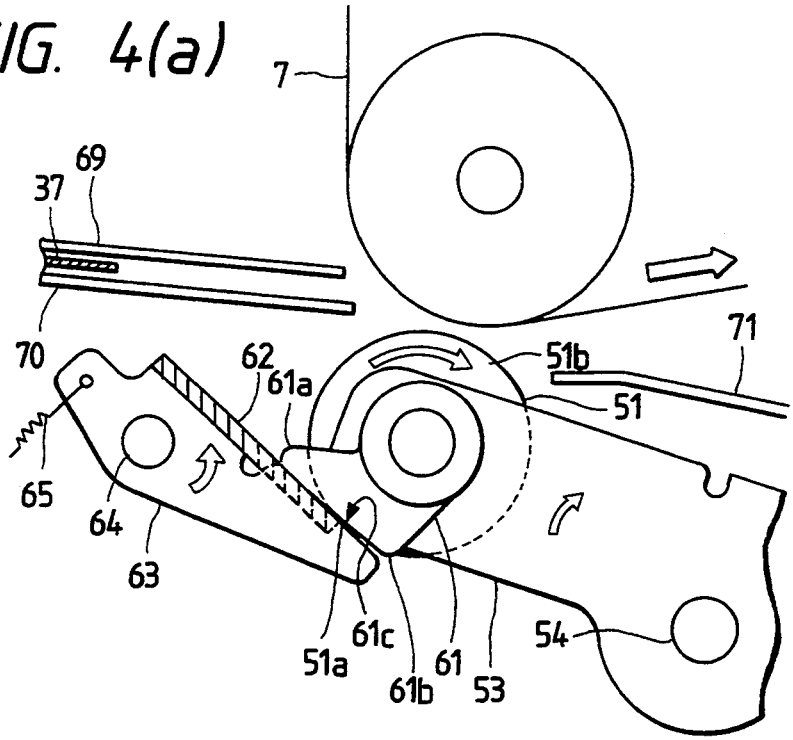
FIG. 4(*a*) is an enlarged side view which shows a transient status from an image-transferring stand-by state to an image-transferring operation.
Figure 4B:
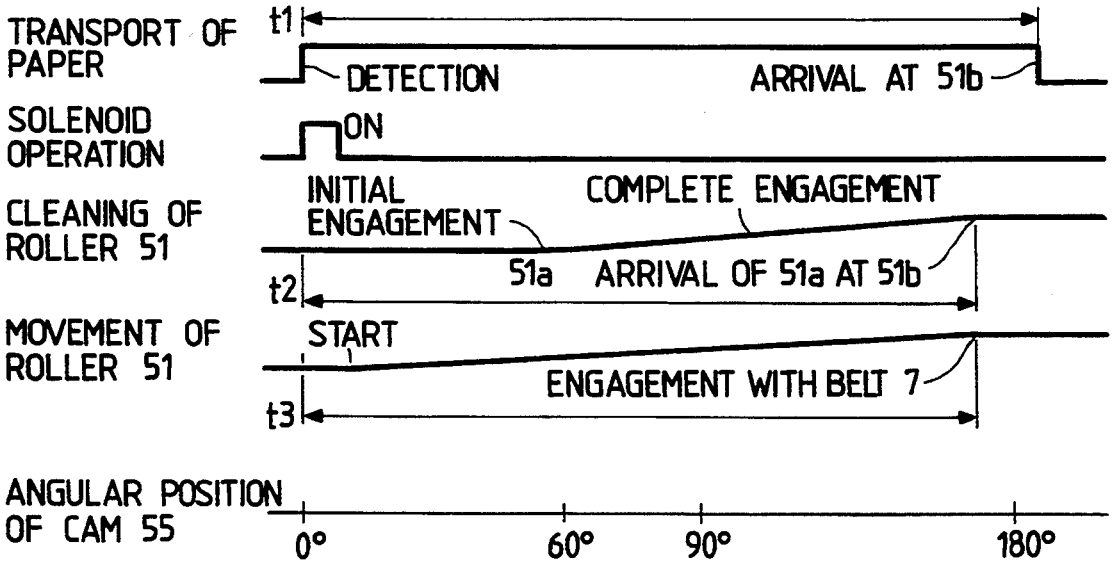

When the cam 55 rotates at an angle of 60 deg from the angular position, as shown in FIG. 1, the pivotable plate 53 then rotates along the peripheral surface of the cam 55 so that a contact area of the cleaner cam 61 with the cleaning frame 63 is, as shown in FIG. 4(*a*), shifted from a first projecting edge 61*a* toward a second projecting edge 61*b* over a fiat surface 61*c*. The cleaning frame 63 which is urged against the cleaner cam 61 by the spring 65 then rotates about the shaft 64 in a counterclockwise direction, as viewed in the drawings, so that the cleaning blade 62 is brought into engagement with a peripheral surface of the transfer roller 51.

FIGS. 4(*b*) shows the operational timing relation between the transfer roller 51 and the cleaning blade 62. In the shown timing chart, t1 represents the transporting time required for the transfer paper 37 to arrive at a contact area 51*b* of the transfer roller 51 with the intermediate transfer belt 7 after the presence of the transfer paper 37 is detected by the sensor 105 at a given location, t2 represents the rotation time during which after the transfer paper 37 is detected, the transfer roller 51 rotates until the contact area 5 1 a at which the transfer roller 51 initially engages the cleaning blade 62 arrives at the contact area 51*b* at which the transfer roller 51 engages the intermediate transfer belt 7, and t3 represents the time required for the transfer roller 51 to engage with the intermediate transfer belt 7 following the detection of the transfer paper 37 at the given location.

As can be seen in the time chart, the cam 55, the cleaner cam 61, and the cleaning frame 62 are so constructed as to set both the time periods t2 and t3 shorter than or equal to the time period t1 ($t1 \geqq t2$, $t1 \geqq t3$). In other words, the operation timing relations among the cam 55, the cleaner cam 61, and the cleaning frame 62 are established so that, before or the moment the transfer paper 37 reaches the contact area 51*b* of the transfer roller 51 with the intermediate transfer belt 7, the transfer roller 51 may engage the intermediate transfer belt 7 and a cleaned surface of the transfer roller 51 by the cleaning blade 62 may range over the contact area 51*b*.

Additionally, a cam profile of the cleaner cam 61 is defined so that the cleaning blade 62 engages the transfer roller 51 completely to produce the proper cleaning effect when the cam 55 further rotates at an angle of 30 deg from the angular position, as shown in FIG. 4(*a*) (i.e., at an angle of 90 deg away from the position, as shown in FIG. 1). At this time, the cleaning blade 62 is slightly flexed, due to elasticity of its own construction material, in engagement with the transfer roller 51.

Figure 5:
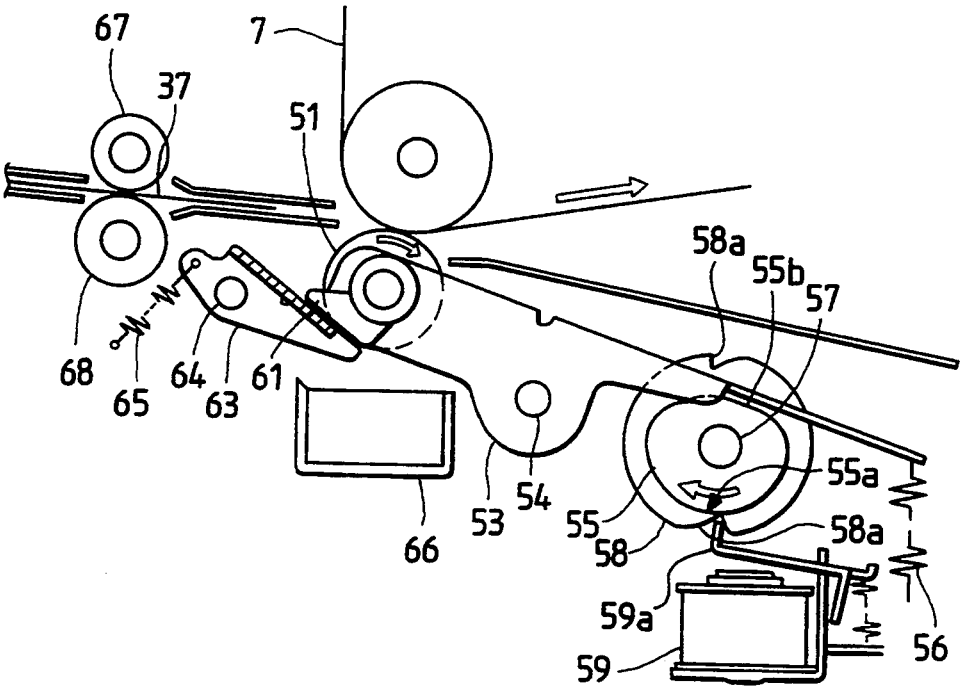
FIG. 5 is a side view which shows an image-transferring device of the invention when serving to image-transfer.

When the cam 55 further rotates at an angle of approximately 90 deg away from the angular position, as shown in FIG. 4(*a*) (i.e., at an angle of about 180 deg away from the angular position, as shown in FIG. 1 ), the transfer roller 51, as shown in FIG. 5, engages the intermediate transfer belt 7 completely. Immediately after this engagement, the transfer paper 37 is fed to the image-transferring station and is then held between the intermediate transfer belt 7 and the transfer roller 51 so that a full color image synthesized on the intermediate transfer belt 7 is transferred, or printed on the transfer paper 37.

Subsequently, when the image-transferred paper 37 has passed through the image-transferring station, the solenoid 59 is turned on and off once again. The half cycle clutch 58 then repeats the above mentioned operation so that the transfer roller 51 is shifted away from the intermediate transfer belt 7 and waits a subsequent image-transferring operation in the position, as shown in FIG. 1. The intermediate transfer belt 7, the transfer roller 51, and the cleaning blade 62 move away from each other in reverse order to the engagement therebetween, as discussed above.

As mentioned above, in the arrangements of the image-transferring device according to the present invention, the cleaning blade 62 is arranged to be engageble with the transfer roller 51, which engagement is established when the transfer roller 51 is urged into engagement with the intermediate transfer belt 7. Therefore, the length of time the transfer roller 51 slides on the cleaning blade 62 is decreased by three-eighths ($\frac{3}{8}$) of that in a conventional system per sheet of transfer paper. As a result, the lifespans of the transfer roller 51 and the cleaning blade 62 may be doubled. Additionally, the engagement/disengagement timing of the transfer roller 51 and the cleaning blade 62 may be controlled with high accuracy, thereby assuring the transfer roller 51 is cleaned completely for providing high quality and clean images.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims. For example, in the above embodiment, the cleaner cam 61 is arranged coaxially with the transfer roller 51. It should be noted however, that the present invention is not limited to same and that a projection functioning as a cam may be formed on part of the pivotable plate 53.

What is claimed is:

1. An image-transferring apparatus comprising:

an image transfer member on which a toner image is formed;

a transfer cylindrical member arranged to hold a transfer paper along with said image transfer member to transfer the toner image formed on said image transfer member onto the transfer paper;

a contact cleaner arranged to engage a surface of said transfer cylindrical member for cleaning the surface of said transfer cylindrical member; and a cleaner supporting member for supporting said contact cleaner and moving said contact cleaner to selectively establish engagement and disengagement with and from said transfer cylindrical member;

wherein said contact cleaner includes a cleaning blade which is made of an elastic material.

2. An image-transferring apparatus comprising:

an image transfer member on which a toner image is formed;

a transfer cylindrical member arranged to hold a transfer paper along with said image transfer member to transfer the toner image formed on said image transfer member onto the transfer paper;

a contact cleaner arranged to engage a surface of said transfer cylindrical member for cleaning the surface of said transfer cylindrical member; and a cleaner supporting member for supporting said contact cleaner and moving said contact cleaner to selectively establish engagement and disengagement with and from said transfer cylindrical member;

wherein said cleaner supporting member is so constructed as to shift said contact cleaner to engage said transfer cylindrical member in synchronism with establishment of engagement of said transfer cylindrical member with said image transfer member.

3. An image-transferring apparatus as set forth in claim 2, wherein said elastic material is made of urethane or silicone rubber.

4. An image-transferring apparatus comprising:

an image transfer member on which a toner image is formed;

a transfer cylindrical member arranged to move toward said image transfer member for holding a transfer paper along with said image transfer member to transfer the toner image formed on said image transfer member onto the transfer paper;

a contact cleaner arranged to engage a surface of said transfer cylindrical member for cleaning the surface of said transfer cylindrical member; and a cleaner supporting member for supporting said contact cleaner so as to selectively establish engagement and disengagement with and from said transfer cylindrical member, said cleaner supporting member being so constructed as to allow said contact cleaner to shift into engagement with said transfer cylindrical member concurrent with the movement of said transfer cylindrical member toward said image transfer member.

5. An image-transferring apparatus as set forth in claim 4, wherein said contact cleaner includes a cleaning blade which is made of an elastic material.

6. An image-transferring apparatus as set forth in claim 5, wherein said elastic material is made of urethane or silicone rubber.

7. An image-transferring apparatus comprising:

an image transfer member on which a toner image is formed;

a transfer cylindrical member arranged to hold a transfer paper along with said image transfer member to transfer the toner image formed on said image transfer member onto the transfer paper;

a cam-like projecting member provided on a transfer cylindrical member supporting member which pivotally supports said transfer cylindrical member;

a contact cleaner operable to clean a surface of said transfer cylindrical member;

a cleaner supporting member [arranged to support]-for supporting said contact cleaner so as to selectively establish engagement and disengagement of said contact cleaner with and from said transfer cylindrical member together with engagement and disengagement of said transfer cylindrical member with and from said image transfer member; and urging means, associated with said cleaner supporting member, for urging said contact cleaner against said transfer cylindrical member, wherein said cam-like projecting member is arranged to establish first and second positions according to position of said transfer cylindrical member supporting member, the first position being to establish engagement with said cleaner supporting member, the second position being to establish disengagement from the cleaner supporting member, when said transfer cylindrical member supporting member is moved to establish engagement of said transfer cylindrical member with said image transfer member, said cam-like projecting member assumes the first position where the cleaner supporting member brings said contact cleaner into engagement with said transfer cylindrical member, when said transfer cylindrical member supporting member is moved to establish disengagement of said transfer cylindrical member from said image transfer member, said cam-like projecting member assumes the second position where said cleaner supporting member brings said contact cleaner out of the engagement with said transfer cylindrical member.

8. An image-transferring apparatus as set forth in claim 7, wherein said cam-like projecting member allows said urging means to urge said contact cleaner into engagement with said transfer cylindrical member at the first position, and restricts said urging means from urging said contact cleaner against said transfer cylindrical member, thereby causing said contact cleaner to be disengaged from said transfer cylindrical member at the second position.

9. An image-transferring apparatus as set forth in claim 7, wherein said cam-like projecting member forms part of said transfer cylindrical member supporting member.

10. An image-transferring apparatus as set forth in claim 7, wherein said contact cleaner includes a cleaning blade which is made of an elastic material.

11. An image-transferring apparatus as set forth in claim 10, wherein said elastic material is made of urethane or silicone rubber.

12. A printing apparatus including an image transfer device, said image transfer device comprising:

an image transfer member on which a toner image is formed;

a transfer cylindrical member arranged to hold a transfer paper along with said image transfer member to transfer the toner image formed on said image transfer member onto the transfer paper;

a cam-like projecting member provided on a transfer cylindrical member supporting member which pivotally supports said transfer cylindrical member;

a contact cleaner for cleaning a surface of said transfer cylindrical member;

a cleaner supporting member for supporting said contact cleaner so as to selectively establish engagement and disengagement of said contact cleaner with and from said transfer cylindrical member together with engagement and disengagement of said transfer cylindrical member with and from said image transfer member; and urging means, associated with said cleaner supporting member, for urging said contact cleaner against said transfer cylindrical member, wherein said cam-like projecting member is arranged to establish first and second positions according to position of said transfer cylindrical member supporting member, the first position being to establish engagement with said cleaner supporting member, the second position being to establish disengagement with the cleaner supporting member, when said transfer cylindrical member supporting member is moved to establish engagement of said transfer cylindrical member with said image transfer member, said cam-like projecting member assumes the first position where said cleaner supporting member brings said contact cleaner into engagement with said transfer cylindrical member, when said transfer cylindrical member supporting member is moved to establish disengagement of said transfer cylindrical member from said image transfer member, said cam-like projecting member assumes the second position where said cleaner supporting member brings said contact cleaner out of the engagement with said transfer cylindrical member.

13. An image-transferring apparatus comprising:

an image transfer member on which a toner image is formed;

a transfer paper engaging member arranged to have a transfer paper engage said image transfer member to transfer the toner image formed on said image transfer member onto the transfer paper;

a cleaner arranged to clean a surface of said transfer paper engaging member;

a supporting member arranged to support said transfer paper engaging member over a range from first to second support positions, the first support position being to establish disengagement of said transfer paper engaging member from said image transfer member, the second support position being to establish engagement of said transfer paper engaging member with said image transfer member; and a cam member for selectively establishing engagement and disengagement of said transfer paper engaging member with and from said cleaner responsive to movement of said supporting member, said cam member bringing said transfer paper engaging member into disengagement from said cleaner when said supporting member assumes the first support position, said cam member bringing said transfer paper engaging member into engagement with said cleaner when said supporting member is shifted from the first support position to the second support position.

14. An image-transferring apparatus as set forth in claim 13, wherein said supporting member includes a cam and a cam follower, said cam follower being pivotally arranged to establish said first and second support positions according to movement of said cam.

15. An image-transferring apparatus as set forth in claim 14, wherein said cam follower is connected to said cam member at an end thereof and to the cam at the other end thereof so that said cam member establishing the engagement and disengagement of said transfer paper engaging member with and from said cleaner according to movement of the cam through the cam follower.

16. An image-transferring apparatus as set forth in claim 13, wherein a cam follower is connected to said cam member at an end thereof and to a cam at the other end thereof so that said cam member establishes the engagement and disengagement of said transfer paper engaging member with and from said cleaner according to movement of the cam through the cam follower.

17. An image-transferring apparatus comprising:

an image transfer member on which a toner image is formed;

a transfer paper engaging member holding transfer paper between same and said image transfer member to transfer the toner image formed on said image transfer member onto the transfer paper;

a contact cleaner urged into constant engagement with a surface of said transfer paper engaging member for cleaning the surface of said transfer paper engaging member; and a supporting member for supporting said transfer paper engaging member so as to selectively establish engagement and disengagement with and from said image transfer member, said supporting member moving said contact cleaner to establish disengagement from the surface of said transfer paper engaging member while shifting said transfer paper engaging member away from said image transfer member.

* * * * *